US009351599B2

(12) United States Patent
Roberts

(10) Patent No.: US 9,351,599 B2
(45) Date of Patent: May 31, 2016

(54) ROLLER ASSEMBLY AND GUIDE FOR A RETRACTABLE SCREEN

(71) Applicant: Freedom Screens of Australia Pty Ltd, Burleigh (AU)

(72) Inventor: Anthony Roberts, Burleigh (AU)

(73) Assignee: Freedom Screens of Australia PTY LTD (AU)

( * ) Notice: Subject to any disclaimer, the term of this patent is extended or adjusted under 35 U.S.C. 154(b) by 36 days.

(21) Appl. No.: 13/963,217

(22) Filed: Aug. 9, 2013

(65) Prior Publication Data

US 2014/0041814 A1 Feb. 13, 2014

(30) Foreign Application Priority Data

Aug. 9, 2012 (AU) ..... 2012211404
Jun. 28, 2013 (AU) ..... 2013206598

(51) Int. Cl.

| | |
|---|---|
| ***E06B 9/08*** | (2006.01) |
| ***A47H 5/03*** | (2006.01) |
| ***E06B 9/54*** | (2006.01) |
| *E06B 9/58* | (2006.01) |

(52) U.S. Cl.

CPC .. *A47H 5/03* (2013.01); *E06B 9/54* (2013.01); *E06B 9/58* (2013.01); *E06B 2009/543* (2013.01)

(58) Field of Classification Search

CPC ..... E06B 9/54; E06B 2009/543; E06B 9/76; E06B 9/56; E06B 9/58; E06B 2009/587

USPC ..... 160/23.1, 267.1, 274, 273.1, 120, 160/268.1, 270, 271

See application file for complete search history.

(56) References Cited

U.S. PATENT DOCUMENTS

| | | | | | |
|---|---|---|---|---|---|
| 3,842,890 | A * | 10/1974 | Kramer | E06B 9/13 | 160/26 |
| 3,911,990 | A * | 10/1975 | Hoover | E06B 9/54 | 160/100 |
| 4,359,081 | A * | 11/1982 | Brower | 160/243 | |
| 4,821,786 | A * | 4/1989 | Johnston | E06B 9/40 | 16/78 |
| 4,825,921 | A * | 5/1989 | Rigter | E06B 9/54 | 160/23.1 |
| 4,884,617 | A * | 12/1989 | Coenraets | E06B 9/581 | 160/190 |
| 5,868,191 | A * | 2/1999 | Blackmon, Jr. | A47H 21/00 | 160/237 |
| 6,119,758 | A * | 9/2000 | Coenraets | 160/273.1 | |
| 6,408,922 | B2 * | 6/2002 | Desrochers | 160/24 | |

(Continued)

FOREIGN PATENT DOCUMENTS

| | | | |
|---|---|---|---|
| AU | 50257/93 | A | 5/1994 |
| WO | 2011/111031 | A2 | 9/2011 |

*Primary Examiner* — Katherine Mitchell
*Assistant Examiner* — Johnnie A Shablack
(74) *Attorney, Agent, or Firm* — Berenato & White, LLC

(57) ABSTRACT

A roller assembly for a horizontally opening retractable screen has a flexible screen with upper and lower toothed edges. Upper and lower guide tracks each have an elongate retaining channel in which an upper and lower edge of the flexible screen is received. The assembly comprises a roller onto which the flexible screen is rolled when the screen is open and from which the flexible screen is unrolled. A guide arrangement is associated with the lower end of the roller that guides the lower toothed edge of the screen into the elongate retaining channel of the lower guide track. The guide arrangement defines a guide passage having an exit aperture through which the lower toothed edge passes during unrolling that communicates with the lower guide track retaining channel, wherein the toothed edge is retained from being pulled out of the exit aperture as it passes therethrough.

15 Claims, 7 Drawing Sheets

(56) References Cited

U.S. PATENT DOCUMENTS 6,463,983 B1 * 10/2002 Lang ..... 160/23.1
6,478,070 B2 * 11/2002 Poppema ..... E06B 9/54 160/23.1
6,629,555 B2 * 10/2003 DeBlock et al. ..... 160/31
6,701,994 B2 * 3/2004 Goldenberg ..... E06B 9/54 160/120
6,854,505 B2 * 2/2005 Grubb ..... E06B 9/80 160/291
6,899,380 B2 * 5/2005 Kralik ..... B60J 7/0015 160/273.1
7,017,644 B1 * 3/2006 Kraeutler ..... E06B 9/174 160/271
7,100,667 B2 * 9/2006 Tomita ..... 160/273.1
7,210,513 B2 * 5/2007 Goldenberg ..... 160/31
7,275,581 B2 * 10/2007 Coenraets ..... 160/273.1
7,370,685 B2 * 5/2008 Moriya et al. ..... 160/290.1
7,487,816 B2 * 2/2009 Moriya et al. ..... 160/31
7,669,634 B2 * 3/2010 Sugiyama et al. ..... 160/242
7,841,377 B2 * 11/2010 Coenraets ..... 160/268.1
7,967,052 B2 * 6/2011 Lin ..... 160/370.22
8,011,413 B2 * 9/2011 Poppema ..... E05D 13/12 160/23.1
8,371,355 B2 * 2/2013 Santoro et al. ..... 160/269
8,516,728 B2 * 8/2013 Jung ..... 40/610
8,528,623 B2 * 9/2013 Roberts ..... 160/267.1
8,656,978 B2 * 2/2014 Goldenberg ..... E06B 9/52 160/122
8,662,138 B2 * 3/2014 Komatsu ..... E06B 9/13 160/194
8,672,014 B2 * 3/2014 Coenraets ..... 160/273.1
2001/0042346 A1 * 11/2001 Brioschi ..... 49/447
2005/0098276 A1 * 5/2005 Agliolo Quartalaro ..... 160/276
2005/0274462 A1 * 12/2005 Nyffenegger ..... E06B 9/54 160/23.1
2006/0289120 A1 * 12/2006 Pielmeier ..... E06B 9/17007 160/23.1
2009/0236050 A1 * 9/2009 Marzilli ..... E06B 9/40 160/241
2010/0101739 A1 * 4/2010 Coenraets ..... 160/267.1
2010/0326605 A1 * 12/2010 Guillen Chico ..... E06B 9/174 160/181
2012/0061032 A1 * 3/2012 Snyder ..... E01F 13/028 160/120
2012/0098301 A1 * 4/2012 Nakamura ..... B60J 7/0015 296/219
2012/0193045 A1 * 8/2012 Lin ..... B60J 7/0015 160/370.23
2014/0041814 A1 * 2/2014 Roberts ..... 160/271
2014/0262084 A1 * 9/2014 Fleischman ..... 160/368.1
2015/0361718 A1 * 12/2015 Hummel ..... E06B 9/54 160/189

* cited by examiner

ROLLER ASSEMBLY AND GUIDE FOR A RETRACTABLE SCREEN

CROSS-REFERENCE TO RELATED APPLICATIONS AND CLAIM TO PRIORITY

This application is related to application numbers 2012211404, filed Aug. 9, 2012 and 2013206598, filed Jun. 28, 2013 in Australia, the disclosure of which is incorporated herein by reference and to which priority is claimed.

FIELD OF THE INVENTION

The present invention relates to a roller assembly and guide for a retractable screen of the type having a flexible screen material that can be drawn off a roller within a housing and across an architectural opening. The present invention is also directed towards a guide member that forms part of the assembly.

BACKGROUND OF THE INVENTION

Retractable screens that can be opened have found appeal with users due to their versatility in being able to be rolled up when not in use. This enables a wide and uninterrupted view when withdrawn. The present invention will be described with particular reference to insect screen mesh. However, it will be appreciated that the invention may relate to other types of flexible screen material and no limitation is intended thereby.

Retractable screens can be mounted across any suitable architectural opening such as windows, doors, and between supports in outdoor areas such as pergolas, gazebos and the like. Retractable screens are generally insect screens. However, other types of screens such as UV or screens or the like may also be retractable.

Retractable screens in general having a roller located within a housing, upon which the screen is rolled onto as the screen is closed and the screen is unrolled from when the screen is opened. The roller is usually biased towards the closed or rolled up position. The housing is typically fixed in place at the top of a vertically opening screen or at the side of a horizontally opening screen. The screen extends between the housing and a moveable handle post that is moveable between an open position towards the housing and a closed position away from the housing. Upper and lower, or right and left guide rails or tracks (for horizontally and vertically opening windows) are operatively engaged with the respective ends of the moveable handle post to guide movement of the post between open and closed positions.

Alternatively, the housing may be located within the moveable handle post, although this is not as preferred for larger screens.

It is important, especially for insect screens, that the edges of the screen are securely held in place such that there are no gaps through which insects may pass. It is also desirable for the screen to have a taut and neat appearance across the face of the screen. Suitably, the longitudinal edges of the screens are retained within a channel in the respective guide tracks and the transverse edge is securely held along the length of the moveable handle post (or housing as the case may be).

In use, a retractable screen is subjected to forces caused by the tautness of the screen such that the screen may pull out of the guide tracks and become loose. This is undesirable for customers. Further, this can create gaps through which insects may pass. When closed, the screens may be subjected to winds that can cause the screen to "blow out" of the guide tracks. To avoid "blow out", the screen receiving channels in the guide tracks and/or the edges of the screen are arranged so that they are securely received therein. The desirability for the screen to be securely held so as to resist "blow out" must be balanced with the ability of the longitudinal edges of the screen to be able to readily slide along the tracks during opening and closing.

Horizontally opening screens can pose problems that are not found with vertically opening screens. As customers are demanding horizontally opening screens of increasing width, the size and weight of the screen increases. The design of the roller and guide tracks must accommodate the increased weight. Weight is less of an issue with vertically opening screens as the roller is at the top and supports the weight of the screen as it opens and closes. The guide tracks simply guide the path of the screen. However, with horizontally opening screens, the weight of the screen must be shared by the guide tracks. The increase in weight, especially borne by the upper guide track can increase the likelihood of blow out. There is accordingly much interest in the retractable screen industry to provide a screen that may alleviate this disadvantage.

One attempt to address the problem of "blow out" has been to provide the screen with a thickened longitudinal edge that is retained within a channel in the guide rail. However, whilst such an arrangement is suitable up to a certain size and weight of a screen, for screens of increasing size and weight, the risk of blow out or malfunction increases.

With vertically opening screens, it is common to use a screen having an edge with a zipper tape heat welded along its longitudinal edge. The zipper is a conventional coil zipper. Coil zippers have teeth formed from a continuous coil of polyester or nylon wound onto a tape. The zipper tape is easily cut to size and is flexible and can be rolled and unrolled. When the tape is welded to a flexible screen, the zipper edge may be securely retained within a retaining channel. The advantages of using a zipper tape as a means of retaining a retractable screen within a vertical guide track having a suitable retaining channel is well known. A further advantage is that the teeth are able to slide smoothly along or within an extruded aluminium guide track.

However, what is also well known is that retractable screens having a zipper tape edge are unsuitable for use on horizontally opening screens. With vertically opening screens, the screens are uniformly rolled onto the roller. When rolled on the roller the weight of the screen is distributed evenly across the roller. In other words, when rolled, the edges of the screen are always in suitable alignment with the guide tracks. This may be compared to horizontally opening screens in which the roller is in a vertical position. In this case, the weight of the screen causes the screen to roll unevenly and/or sag due to its weight. This is exacerbated with increasing weight of the screen. The edge of the screen is therefore often not in correct alignment with the guide track. This is of little consequence when the edge of the screen is continuous such as a thickened edge. However, in the case of a discontinuous edge, such as in the case of a zipper edge having separated teeth, the edge is subject to being caught up as it exits the housing and enters the retaining channel of the guide track. Also entering the retaining channel at an angle can cause the teeth to slip from the channel.

The present invention it therefore directed towards providing a horizontally opening retractable screen in which the screen has toothed edges.

SUMMARY OF THE INVENTION

According to a first broad form of the invention, there is provided a roller assembly for a horizontally opening flexible retractable screen having upper and lower toothed edges; upper and lower guide tracks, each guide track having an elongate retaining channel in which a respective upper and lower toothed edge of the flexible screen is received;

wherein the assembly comprises a roller onto which the flexible screen is rolled when the screen is open and from which the flexible screen is unrolled when the screen is closed and a guide arrangement associated with the lower end of the roller that guides the lower toothed edge of the screen into the elongate retaining channel of the lower guide track, the guide arrangement defining a guide passage having an exit aperture through which the lower toothed edge passes during unrolling that communicates with the lower guide track retaining channel, wherein the toothed edge is retained from being pulled out of the exit aperture as it passes therethrough.

The roller assembly of the present invention forms part of a horizontally opening retractable screen. The screen is typically an insect screen, but may be any other suitable flexible screen. Generally, the roller is fixed to one side of an architectural opening and the other end of the screen is attached to a moveable handle post. However, in some cases, the roller may be located within a moveable handle post and the opposite end of the screen is mounted to a fixed post.

The flexible screen has upper and lower toothed edges. By toothed edge it is meant any edge having a series of spaced thickened projections that can be retained within a retaining channel of a guide track. The projections are typically zipper teeth and especially preferred are coil zipper teeth mounted onto a zipper tape. The base of the teeth are thickened with respect to the tape and are securely bound to the tape. The tape can be heat welded onto the edges of a screen by means know in the art.

Roller assemblies for retractable screens typically have a roller mounted within a housing. The housing generally has upper and lower end caps, each with an internal projection upon which the roller is mounted. For aesthetic purposes and to protect the roller, the assembly includes a housing body surrounding the roller to which the upper and lower end caps are mounted. The end caps have a slot in that side of the end cap that faces and abuts an end of the guide track. The slot aligns with a screen retaining channel in the guide track so that the edges of the screen pass through the slot and into the retaining channel during rolling and unrolling of the screen The roller assembly includes a guide arrangement for guiding the lower toothed edge of the screen into the retaining channel of the guide track.

When the roller assembly includes a lower end cap, the guide arrangement is suitably located within the lower end cap. The guide arrangement may be integrally formed as part of the end cap. Alternatively and preferably, the guide arrangement includes a guide member that is engageable with the end cap. An advantage of having a discrete guide member is that the guide member can be injection moulded separately from a thermoplastics material that is more suitable for its purpose than the material from which the end cap is moulded.

Suitably, the guide member and inner surface of the end cap cooperate to define the guide passage.

According to a further broad form of the invention there is provided a lower end cap for a roller assembly for a horizontally opening flexible retractable screen in which a flexible screen with a upper and lower toothed edges is rolled and unrolled into elongate retaining channels in upper and lower guide tracks;

wherein the end cap assembly includes an end cap body and a guide member engageable with the end cap body, wherein the guide member at least partially defines a guide passage that guides the lower toothed edge of the screen into the elongate retaining channel of the lower guide track, the guide passage having an exit aperture for the toothed edge during unrolling that communicates with the lower guide track retaining channel whereby the toothed edge is retained from being pulled out of the exit aperture as it passes therethrough.

The guide member may be engageable with the end cap by any suitable means. Suitably the guide member is adapted for press or friction fit engagement with the end cap. The guide member or end cap may have one or more projections or recesses that are engageable with one or more recesses or projections on the other of the end cap or guide member.

Suitably, the guide member cooperates with an internal wall of the cap body to define the guide passage.

The exit aperture of the guide arrangement communicates with the retaining channel of the guide track so that the toothed edge of the screen can pass through the exit aperture to the retaining channel. The communication may be direct in which case, the retaining channel is adjacent or abutting the exit aperture or indirect in which case, there may be a spacer or some other component intermediate the exit aperture and the retaining channel of the guide member. In this case, the spacer or other component has a through passage through which the toothed edge passes as it travels from the exit aperture to the retaining channel.

In the embodiment where the exit aperture communicates directly with the retaining channel it is preferred that the exit aperture and the retaining channel, each have profiles that substantially correspond or align. This minimises or reduces the likelihood that the teeth may catch on protruding edges. In this case, it will be appreciated that it is important that the correct alignment is maintained during use. This may be achieved by ensuring that the end of the guide track is secured in a manner that minimises lateral movement of the guide track and retaining channel with respect to the exit aperture.

The guide arrangement has an exit aperture through which the toothed edge passes and in which the toothed edge is retained. As the exit aperture communicates with the retaining channel on the guide track, the ability to retain the edge within the exit aperture ensures the toothed edge is fed into the guide track retaining channel in a manner that may avoid catching of the teeth. Suitably, the exit aperture has a profile that substantially correlates or aligns with the guide track retaining channel so as to reduce the likelihood of the toothed edge catching on any edges.

The toothed edge is retained from being pulled out of the exit aperture. Suitably the exit aperture has a profile that is substantially the same as the profile of the retaining channel in the guide track in which the exit aperture is in communication. The profiles suitably have an elongate opening that is sufficiently wide for the screen to extend through but narrow enough to retain the toothed edge from being pulled out of the exit aperture or retaining channel respectively.

It is known to provide locating tabs or projections on the end cap that are complimentary to a C section on the guide track so as to align the retaining channel with the slot in the end cap so that the screen edges can smoothly pass out of the slot and into the retaining channel. When the C section receives the locating projection the retaining channel and the exit aperture are in alignment. This may provide a satisfactory outcome. However, in use, the screens are subject to forces during opening and closing that can cause some misalignment between the slot and the retaining channel. Such misalignment can cause the teeth of the screen to catch or become jammed between the slot and the retaining channel. It is possible to devise methods of securely joining the guide track to the end cap to avoid relative movement. However, this can add to assembly costs.

The present inventor has addressed this problem by providing a spacer or component between the or each guide arrangement and the or each guide track. The spacer has a through passage through which the toothed edge passes from the exit aperture of the guide arrangement to the retaining channel of the guide track.

The spacer has a first side that is engageable with the guide track in such a way so as to resist lateral movement with respect to the guide track. In other words the through channel and the retaining channel remain in alignment, even with movement of the guide track.

Extruded aluminium guide tracks generally have profiles include at least one channel. Suitably, the guide engaging side of the spacer has at least one projection that compliments the at least one channel so that the spacer can slidably engage the end of the guide track and when engaged resist lateral movement with respect thereto.

The spacer has an opposite or second side that adjoins the end cap. Suitably the spacer has a recess that receives or aligns with a locating projection on the end cap.

The through passage extends between the first and second sides such that it has an entry aperture that communicates with the exit aperture of the guide arrangement and an exit aperture that communicates with the retaining channel of the guide track. The through passage is tapered towards the first guide track engaging side. The exit aperture of the through passage is suitably substantially the same size as the retaining channel. Thus, in this embodiment the entry aperture is larger than the exit aperture of the guide arrangement. This larger size means that any lack of alignment between the guide track and the guide arrangement does not cause the toothed edge to become jammed or otherwise caught up as it exits the exit aperture in the guide arrangement.

The taper of the through passage provides a smooth guide for the toothed edge to guide it into alignment with the exit aperture for a smooth passage into the retaining channel of the guide track. As the spacer does not move laterally with respect to the guide track, the exit aperture of the spacer remains in alignment with the retaining channel of the guide track.

In the preferred embodiment when the toothed edge is a zipper tape, the guide passage is dimensioned to have a lower section for passage of the teeth and an upper section for passage of the tape.

The upper section of the guide passage may have a curved edge leading into the passage so as to guide the lower part of the screen into the guide passage.

Suitably, the lower part of the guide passage is defined by a guide ramp that is upwardly inclined in the direction of travel of the screen during unrolling so that it will guide the edges of the screen that may have sagged upwards towards the exit aperture. The ramp flattens out towards the exit end and the flattened portion defines the base of the exit passage. The teeth travel along the ramp and as the ramp is smooth the teeth can smoothly travel without getting caught up.

The upper part of the guide passage is suitably defined on one or both sides by downwardly inclined guide rails that direct the base of the teeth downwards towards the exit aperture. The arms extend into the guide passage and retain the teeth within the exit passage. The width of the guide rails are dimensioned to be substantially the same as the width of the base of the teeth that are in contact with the guide rail.

In the form of the invention, having a guide member engageable with an end cap, one guide rail is suitably located on the guide member and the opposed guide rail is integrally formed on the inner wall of the end cap.

Preferably, the roller assembly includes a guide portion to guide the upper edge of the screen into the upper guide track. The upper guide portion is generally identical except inverted when compared to the bottom guide portion.

According to a further broad form of the invention, there is provided a horizontally opening retractable screen including:

a fixed roller;

a displaceable handle post;

a flexible screen extending between the fixed roller and the handle post, the flexible screen having upper and lower toothed edges;

upper and lower guide tracks operatively engaged with the fixed roller and the displaceable handle post, each guide track having an elongate retaining channel for retaining the toothed edges of a respective edge of the flexible screen;

a lower guide arrangement associated with the lower end of the roller that guides the lower toothed edge of the screen into the elongate retaining channel of the lower guide track, the guide arrangement defining a guide passage having an exit aperture through which the lower toothed edge passes during unrolling that communicates with the lower guide track retaining channel, wherein the toothed edge is retained within the exit aperture as it passes therethrough.

Suitably the screen has an upper guide arrangement associated with the upper end of the roller. Suitably, the screen includes upper and lower end caps for the roller. The end caps may be as described above. Suitably the guide arrangement includes a guide member as described above.

Suitably, the retractable screen includes a spacer between the guide track retaining channel and the or each guide arrangement.

DETAILED DESCRIPTION OF THE PREFERRED EMBODIMENT(S)

Figure 1:
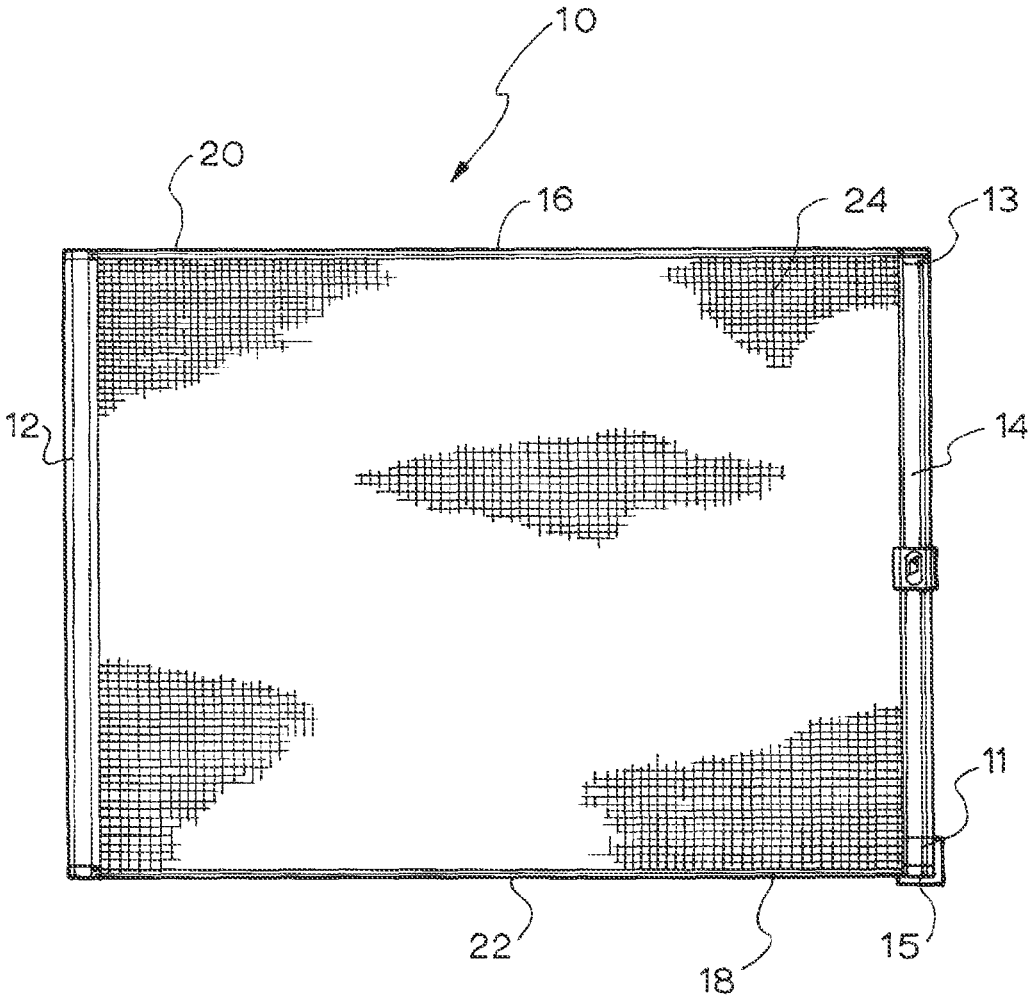
FIG. 1 is a front view of a retractable screen assembly in accordance with one embodiment of the present invention.

FIG. 1 shows a front view of a horizontally opening retractable screen 10. The screen 10 has a fixed housing 12 and a displaceable handle post 14 that is displaceable towards and away from the housing 12 between an open and a closed position.

The screen 10 has upper 16 and lower 18 guide tracks which are operatively engaged with upper 13 and lower 15 ends of the handle post 14 for guiding the handle post 14. The guide tracks 16, 18 are extruded aluminium having a profile that will be discussed below.

The screen 10 also includes a flexible sheet of insect screen mesh 24 extending between the housing 12 and the displaceable handle post 14. The mesh 24 has upper and lower longitudinal edges 20, 22 to which a zipper tape has been welded. The zipper is suitably a coil zipper. Coil zippers may be made from a polyester resin or other plastics material. An advantage of these materials is that they are that they are strong and flexible which allows the tape to easily roll and unroll. Further the teeth are able to slide easily along an extruded aluminium guide channel (as discussed below).

Figure 2:
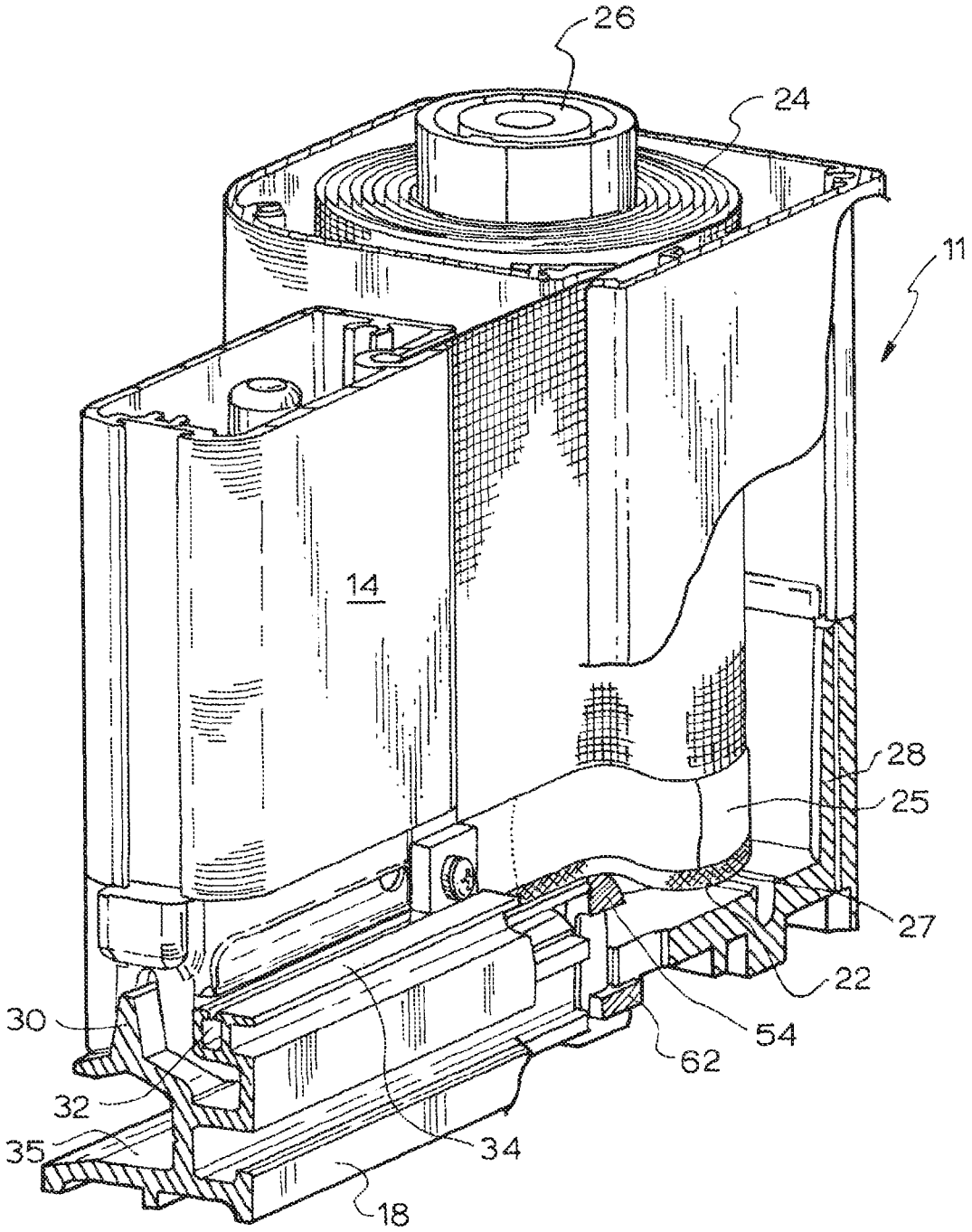
FIG. 2 is a perspective, partially cut away view of a lower section of the screen assembly of FIG. 1.
Figure 3:
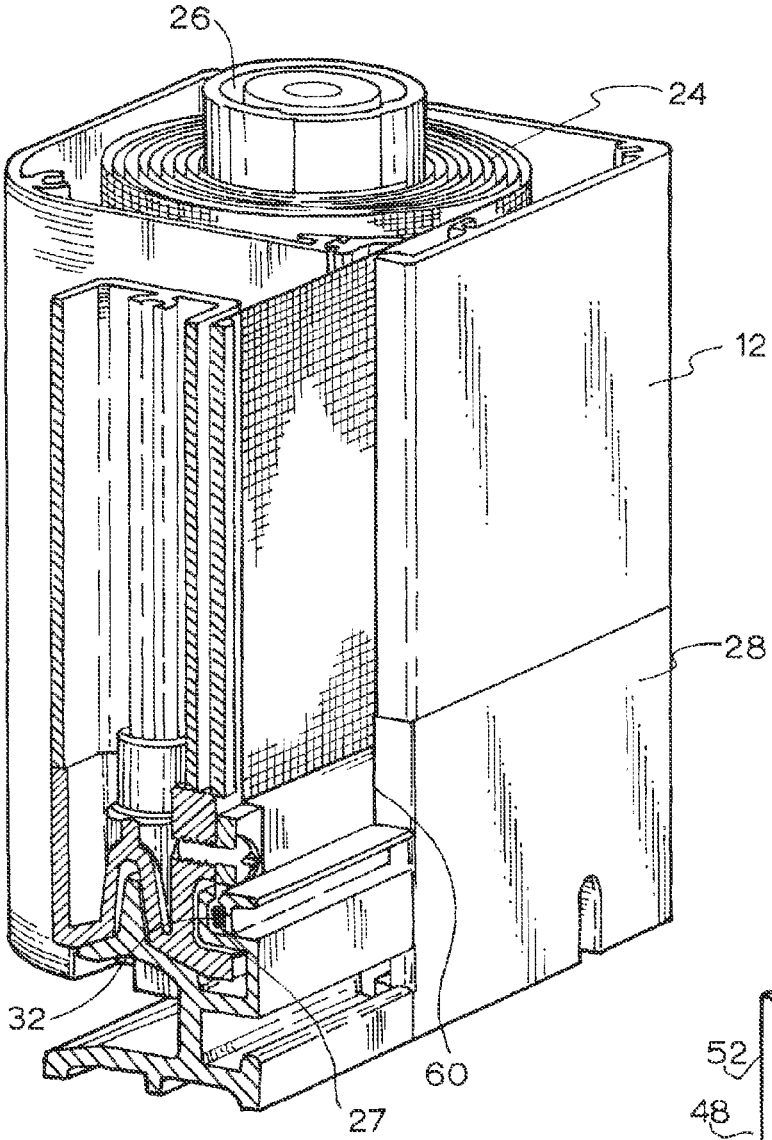
FIG. 3 is another perspective, partial cut away view of the section of the assembly as shown in FIG. 2 with the screen in the closed position.

FIGS. 2 and 3 show a partial view of a lower corner 11 of the screen 10 when in the closed position. The housing 12 has a roller 26 on to which the sheet mesh 24 is rolled. The roller 26 is biased towards the closed position. Means for biasing a roller to the closed position are known in the retractable screen arts and forms no part of the present invention. FIG. 2 shows schematically that the bottom edge of the mesh 24 sags unevenly due to the weight of the mesh. The edge of the mesh 24 is shown welded to a zipper tape 25 having coil zipper teeth 27 (although the individual teeth are not shown).

The housing 12 has a bottom end cap 28 upon which the roller 26 is mounted. The housing 12 has a slot 60 (shown in FIG. 3) through which the mesh 24 passes as it rolls and unrolls from the roller 26.

The screen 10 is shown in the closed position in which the handle post 14 abuts the housing 12. The profile of the lower guide track 18 may be seen in this Figure. The upper guide track 16 has an identical profile. The guide track 18 has a guide rail 30 that guides the handle post 14. The guide track 18 also has a mesh retaining channel 32 that is U shaped with opposed upper retaining edges 34 that are spaced to allow the taped edge 25 of the mesh to pass through but will retain the coiled teeth 27 within the channel 32. The guide track 18 cooperates with the end cap 28 so that the lower edge 22 of the mesh 24 can pass from the lower cap 28 to the guide channel 32.

Figure 5:
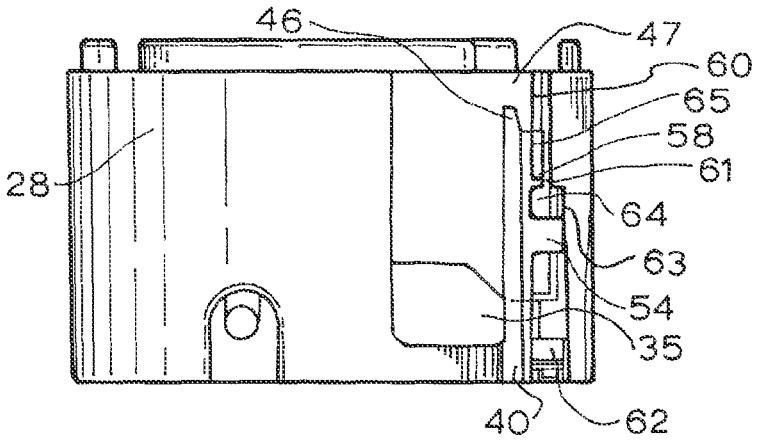
FIG. 5 is a front view of the housing of the assembly shown in FIG. 1 with the guide member shown in FIG. 4 installed.

The guide track 18 has a C shaped section 9 that in use receives a complimentary locating projection 8 on the end cap 28 (as shown in FIG. 5) so as to facilitate assembly.

FIG. 3 is the same view as FIG. 2, except that the handle post 12 is cutaway so that the cross section of the screen 26 may be seen. The zipper teeth 27 may be seen retained in channel 32.

The lower edge of the screen is guided from inside the housing 12 and into the channel 32 by means of a guide member 40 that is located within the lower end cap 28 of the housing 12. The lower part of the guide member 40 is shown in FIG. 2.

Figure 4:
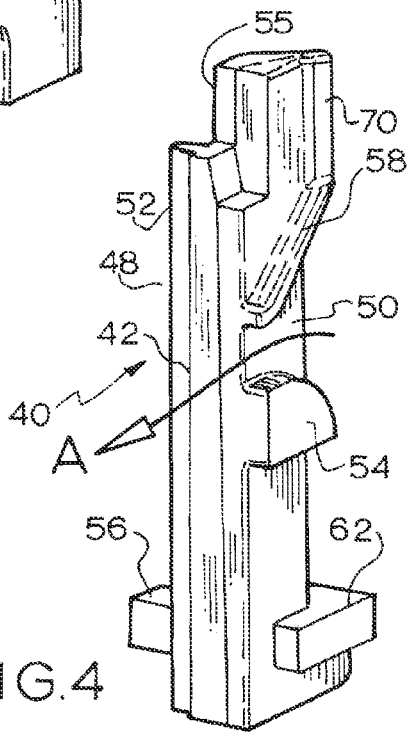
FIG. 4 is a perspective view of a preferred guide member of the present invention.

FIG. 4 is a perspective view of the guide member 40. The guide member 40 is formed from an extruded thermoplastics material such as polypropylene.

The guide member 40 has a front face 42, that in use forms part of the external wall of the housing end cap 28. The guide member 40 has an upper keyed portion 46 that is adapted to receive a complimentary keyed portion 47 of the end cap 28 (This will be shown and discussed with respect to FIG. 5). The guide member 40 has opposing side faces; one face 48 is adapted to engage a wall of the end cap 28 and the other side face 50 is adapted to guide the edge of the mesh 24 onto the guide track 18. The engagement side face 48 has a longitudinally extending rib 52 that in use is received within a complimentary recess in the housing cap wall. The engagement side face 48 also has a contact surface 55 that in use abuts against a flange extending internally into the end cap 28. Further means of engaging the end cap 28 is provided by foot 56 that is received by a recess in the bottom surface of the end cap 28.

The guide face 50 of the guide member 40 has a curved guide ramp 54 which in use, guides the zipper teeth 27 as the mesh 24 is unrolled from the roller and the mesh 24 travels in the direction indicated by arrow A. The ramp 54 is smooth so as to provide no or little opportunity for the teeth 27 to catch and provides a smooth path for the terminal ends of the zipper teeth to travel from the housing to the guide track 18. The ramp 54 provides an upwardly curved path that lifts the sagged lower end of the mesh 24 upwards. The ramp 54 may be seen in the cut away section as shown in FIG. 2.

The guide member 40 also has a guide rail 58 that is downwardly inclined towards the front face 42. In use, this guide rail 58 cooperates with an opposing guide rail on the inner surface of the housing cap 28 to direct the zipper downwards towards the guide track should it begin to rise up. The rail is 58 dimensioned such that the base of the teeth can slide along the respective rails.

The guide member 40 further includes a shoulder 70, which will be discussed further below.

FIG. 5 shows a front view of the guide member 40 in engagement with the end cap 28. This figure shows how the guide member 40 is received within a slot 60 in the end cap 28. The ramp 54 extends across the full width of slot 60 define by opposed side walls 63, 65. The lower foot 62 also extends across the width of slot 60 and abuts wall 63 so as to provide a further point of press fit contact with the end cap 28. The complimentary keyed portions 46, 47 of the guide member 40 and the housing may be seen.

The guide member 40 is held within the end cap 28 in a press or friction fitting engagement. During assembly, the guide member 40 is pushed upwardly into position within slot 60. Upwards movement is stopped as the keyed portion 46 meets the complimentary keyed portion 47 of the end cap and as foot 54 is received within a recess in the bottom wall of the end cap 28.

The top of the ramp 54, trailing end of the guide rail 58 and opposed side 63 of the end cap 28 defines an exit aperture 64 having an identical profile to the retaining channel 32 on the guide track 18. The exit aperture 64 communicates with retaining channel 32 so that the zipper teeth 27 are smoothly guided from the interior of the end cap by the guide member 40 and into the retaining channel 32 without catching. Further the zipper teeth 27 are guided into the retaining channel 32 horizontally so that it is smoothly received therein.

The exit aperture 64 forms the lower part of a guide passage 61 through which the lower toothed edge 27 of the screen 24 is guided. The guide passage 61 is defined between the guide member and the opposing inner wall 63 of the end cap 28.

Figure 6:
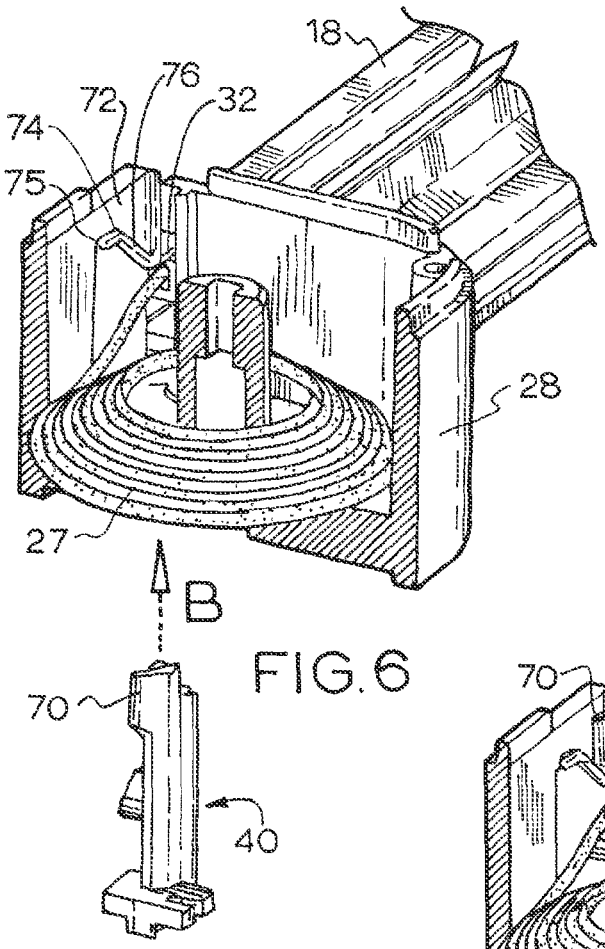
FIG. 6 is a cut away and exploded view of the interior of the section shown in FIG. 2 housing of the assembly as shown in FIG. 1.
Figure 7:
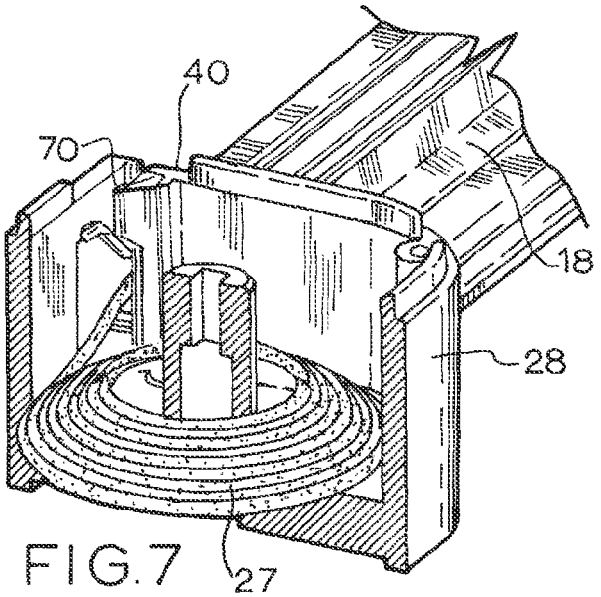
FIG. 7 is the same view as FIG. 6 in the assembled position.

FIGS. 6 and 7 are schematic cut away views of the bottom of the housing 12 shown from the inside of the end cap 28. FIG. 6 is an exploded view showing how the guide member 40 is inserted into the slot 60 in the end cap 28 in the direction of arrow B. For illustrative purposes, the tape and mesh are not shown and only the zipper edge 27 is shown. The zipper edge 27 is shown as it passes through slot 60 and into the retaining channel 32 of the guide track 18.

The inner wall 72 of the end cap 28 has a guide rail 74 integrally formed therein. This guide rail 74 has a first horizontal portion 75 and an angled portion 76 that is angled downwards towards the channel 32. The guide rail 74 is opposed to guide rail 56 of the guide member 40. If the zipper edge 27 travels too high, the guide rail 74 in concert with the opposed guide rail 58 of the guide member 40 will redirect the zipper edge 27 downwards towards channel 32.

FIG. 7 is the same view as that of FIG. 6 with the guide member 40 installed. The rounded shoulder 70 of the guide member 40 may be seen. The upper part of the entry to the guide passage 61 for the tape is defined between the rounded shoulder 70 and the guide rail 74. It will be appreciated that as the mesh unrolls, the tape section enters the passage 61 at an angle. The rounded shoulder 70 serves to smoothly guide the tape into the guide passage 61.

Figure 8:
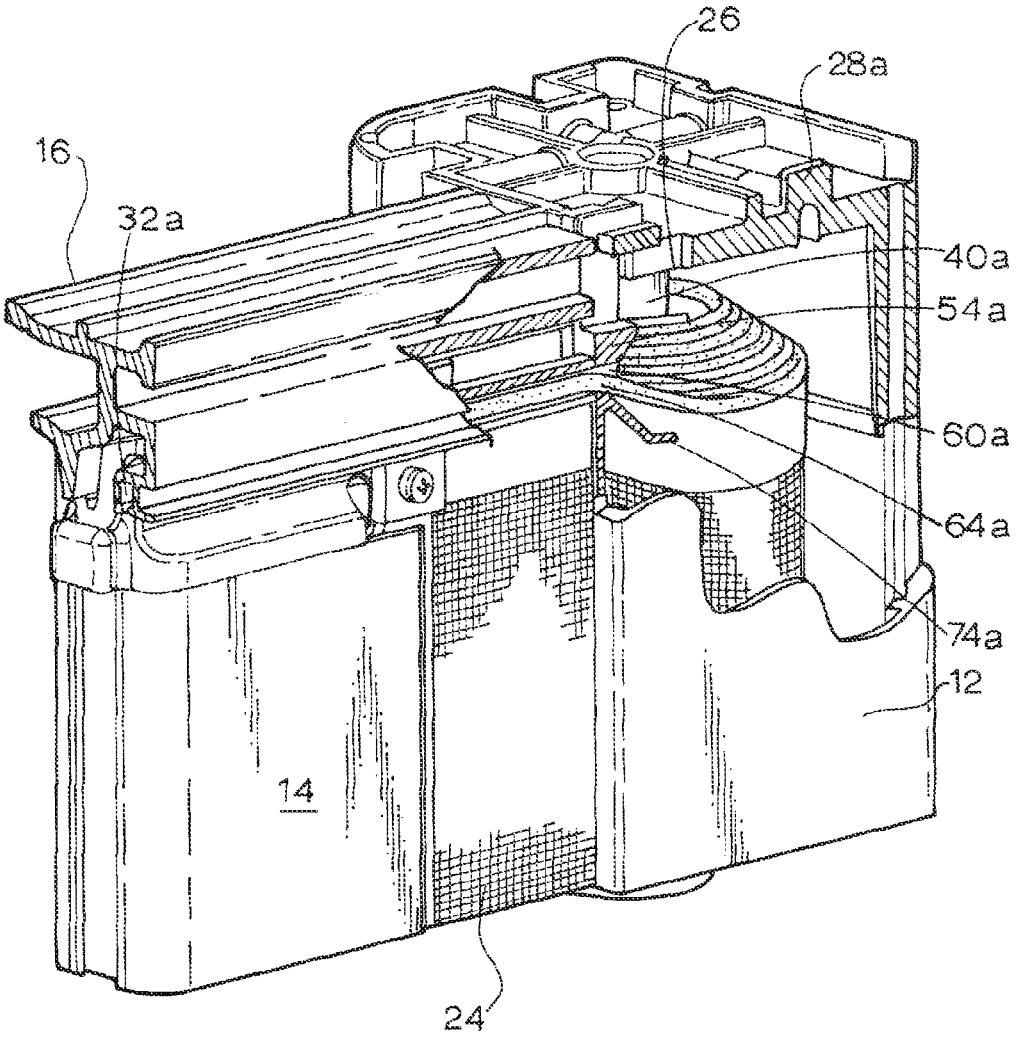
FIG. 8 is a perspective cut-away view of the upper section of the housing of the assembly as shown in FIG. 1.

FIG. 8 shows a cut away view of the upper corner of the housing 12. The upper part of housing also has an end cap 28*a* that is a mirror image of the lower cap 28. A guide member 40*a* is also inserted into the upper part of slot 61*a* in a similar manner as describe above. The guide member is however in the inverted position in which guide ramp 54*a* directs the zipper edge downwardly.

The inner surface of the cap 28*a* also has a guide rail 74*a* that is the same as the guide rail 74, except also inverted. The guide rail 74*a* and the opposed guide arm 56*a* on the guide member 40*a* lift the zippered edge of the sagging mesh to direct it into guide channel 32*a* of the upper guide track 16. The ramp 54*a* prevents the zippered edge from travelling too high.

Figure 9:
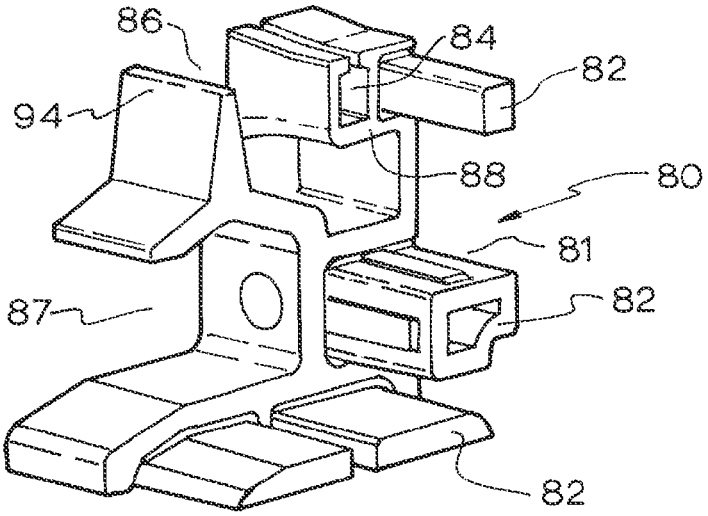
FIG. 9 is a rear perspective view of a preferred spacer for use with an embodiment of the guide arrangement of the present invention.
Figure 10:
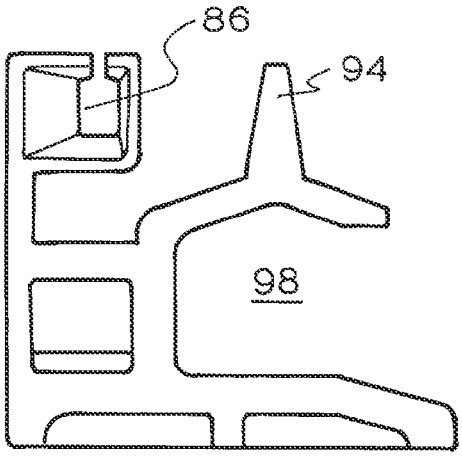
FIG. 10 is a side view of one side of the spacer shown in FIG. 9.
Figure 11:
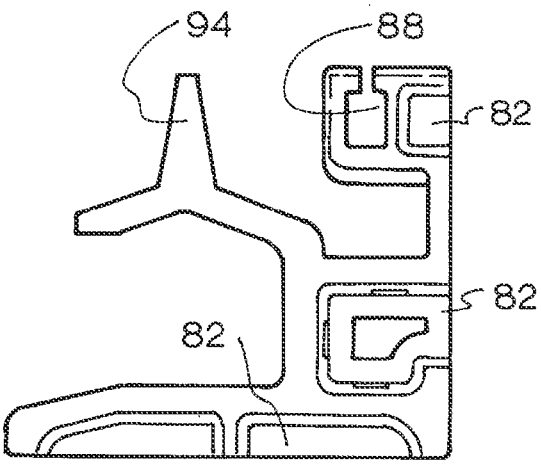
FIG. 11 is the other side view of the spacer as shown in FIG. 9.

FIGS. 9 10 and 11 show a preferred spacer 80 for use with a roller assembly or end cap of the present invention. The spacer 80 is placed between the guide track and the end cap as will be described further below. The spacer 80 has a rear side face 81 and a front side face 87. The rear side face 81 engages the guide track of the roller assembly. The rear side face 81 has 4 projections 82 that are dimensioned to snuggly fit within complimentary channels in the guide track.

The spacer 80 has a through passage 84 through which the toothed edge of the screen passes as it is rolled onto and unrolled from the roller. The through passage 84 has an entry aperture 86 on the front face 87 that is adjacent the end cap and an exit aperture 88 that is adjacent the guide track 18 when the screen is being pulled out or unrolled. The through passage is 84 tapered from the front 87 to the rear face 81. The dimensions of the exit aperture 88 are identical to that of the retaining channel 32 in the guide track 18.

Figure 12:
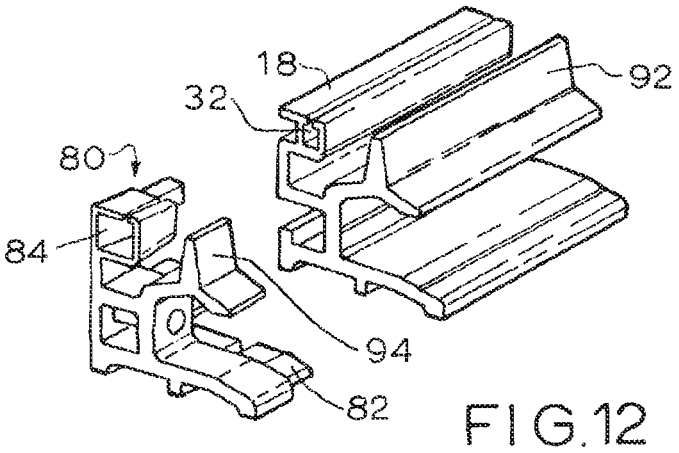
FIG. 12 is a front perspective open in line for assembly view of the spacer shown in FIG. 9 and a guide track.

FIG. 12 shows the spacer 80 and the guide track 18 to which it is engaged in use. The guide track has channels 90 that complimentary receive projections 82. It will be appreciated that when engaged lateral movement of the spacer 80 with respect to the retaining channel 32 of the guide track 18 is avoided or minimized. In practice this means that the exit aperture 88 of the though passage 84 and the retaining channel 32 remain in alignment.

The guide track 18 has a guide rail 92 upon which the hand post slides. The spacer 80 has a profile that has a rail portion 94 that an identically shaped profile to the guide rail 92 so that the handle post can slide onto the rail portion 94 of the spacer 80.

Figure 13:
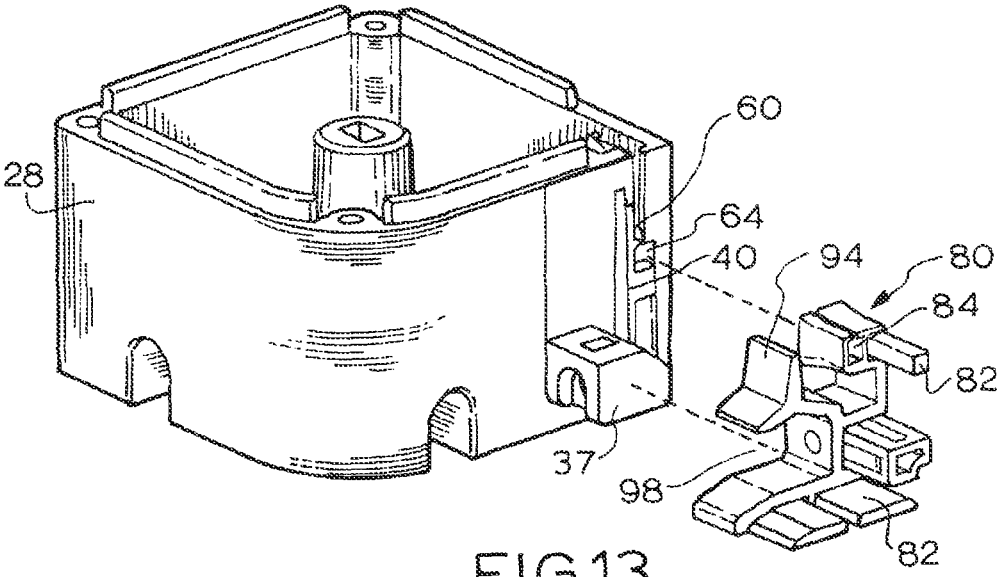
FIG. 13 is a perspective open in line for assembly view of the spacer shown in FIG. 9 and end cap of a roller assembly.
Figure 14:
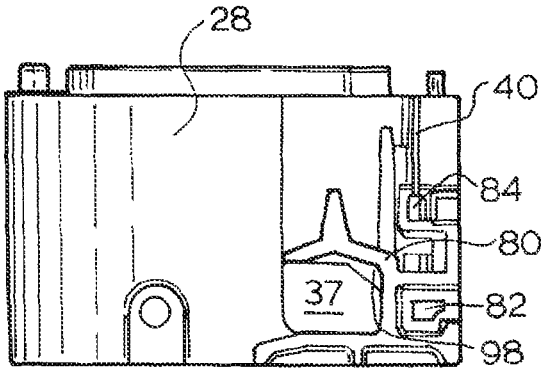
FIG. 14 is a front view of the spacer shown in FIG. 9 engaged with the end cap of the screen assembly that is shown in FIG. 5.

FIG. 13 shows the spacer 80 in line for assembly with the end cap 28. The spacer 80 has a C shaped section 98 that receives locating projection 8. The exit aperture 64 of the guide arrangement aligns with the entry aperture 86 of the spacer 80. The entry aperture 84 of the spacer 80 is larger than exit aperture 64. This means that any misalignment between the spacer 80 and the exit aperture 64 may be tolerated by the difference in size. Also as the though passage 84 is tapered towards the exit aperture 86 the toothed edge is smoothly guided by the tapered through passage towards the retaining channel 32 of the guide track 18. FIG. 14 shows a front view of the spacer 80 and end cap 28.

It will be appreciated that the roller assembly and guide of the present invention allows a flexible screen having a zipper tape edge to be used on a horizontally opening screen in a manner in which the risk of the teeth being caught up or entering the retaining channel of the guide track unevenly may be minimized.

In fact, the present inventor has observed that in the absence of the guide, the mesh will not pull out of the housing at all. Without the guide, the zip will roll up unevenly or cross over itself. Either of these two situations cause the mesh to lock-up and not pull out of the housing at all.

A smooth passage of the mesh into and out of the housing is achieved by providing an exit aperture in the guide passage that retains the teeth as the teeth exit the assembly and are thereby guided into the retaining channel on the guide track.

Further any misalignment between the end cap and the guide track may be tolerated by providing a spacer between the end cap and the guide track.

It will be appreciated that various changes may be made to the invention as described and claimed herein without departing from the spirit and scope thereof.

I claim:

1. A roller assembly for use with a horizontally opening retractable screen including a flexible screen with an upper toothed edge, and for use with an upper guide track having an upper elongate retaining channel in which the upper toothed edge is received, said roller assembly comprising:

a roller having an upper end and a lower end, said roller being configured to permit rolling of the flexible screen thereon when the flexible screen is open and unrolling of the flexible screen therefrom when the flexible screen is closed;

an upper end cap having an upper end cap body to which said upper end of said roller is rotatably mountable; and an upper guide arrangement comprising an upper guide member that is engageably receivable within said upper end cap body so as to define an upper guide passage with a first side wall of said upper guide passage defined by said upper guide member and a second side wall of said upper guide passage defined by an inner surface of said upper end cap body, said upper guide passage having an upper exit aperture through which the upper toothed edge passes during unrolling of the flexible screen and is configured to communicate with the upper elongate retaining channel, said first side wall having a first upper guide rail that is upwardly inclined towards said upper exit aperture and said second side wall having an opposite second upper guide rail that is upwardly inclined towards said upper exit aperture for guiding the upper toothed edge upwards towards said upper exit aperture, said upper exit aperture being configured to retain the upper toothed edge from being pulled out of said upper exit aperture as the upper toothed edge passes through said upper exit aperture.

2. The roller assembly of claim 1, further comprising said upper guide track, wherein said upper exit aperture has a profile that corresponds to a profile of said upper elongate retaining channel.

3. The roller assembly of claim 1, wherein said upper guide member is configured for press fit or frictional engagement within said upper end cap body.

4. The roller assembly of claim 1, wherein said upper guide member further comprises an upper ramp downwardly inclined towards said upper exit aperture.

5. The roller assembly of claim 4, wherein said first and second upper guide rails collectively define a lower base of said upper guide passage, and wherein said upper ramp defines an upper face of said upper guide passage.

6. The roller assembly of claim 1 further comprising said upper guide track and a spacer positionable between said upper guide arrangement and said upper guide track, wherein said spacer has a first side that is engageable with said upper guide track so as to resist lateral movement with respect to said upper guide track, a second side that is positionable adjacent said upper guide arrangement, and a through passage configured to pass the upper toothed edge from said upper exit aperture of said upper guide arrangement to said upper elongate retaining channel of said upper guide track, and wherein said through passage is tapered from said second side towards said first side.

7. The roller assembly of claim 6, wherein said upper guide track has at least one further channel in addition to said upper elongate retaining channel, and wherein said first side of said spacer has at least one projection that complements said at least one further channel in said upper guide track so that said spacer is slidably engagable with said upper guide track.

8. A roller assembly for use with a horizontally opening retractable screen including a flexible screen with an upper toothed edge and a lower toothed edge, and for use with upper and lower guide tracks, the upper guide track having an upper elongate retaining channel in which the upper toothed edge is received, the lower guide track having a lower elongate retaining channel in which the lower toothed edge is received, said roller assembly comprising:

a roller having an upper end and a lower end, said roller being configured to permit rolling of the flexible screen thereon when the flexible screen is open and unrolling of the flexible screen therefrom when the flexible screen is closed;

an upper end cap having an upper end cap body to which said upper end of said roller is rotatably mountable;

a lower end cap having a lower end cap body to which said lower end of said roller is rotatably mounted;

an upper guide arrangement comprising an upper guide member that is engageably receivable within said upper end cap body so as to define an upper guide passage with a first side wall of said upper guide passage defined by said upper guide member and a second side wall of said upper guide passage defined by an inner surface of said upper end cap body, said upper guide passage having an upper exit aperture through which the upper toothed edge passes during unrolling of the flexible screen and is configured to communicate with the upper elongate retaining channel, said first side wall having a first upper guide rail that is upwardly inclined towards said upper exit aperture and said second side wall having an opposite second upper guide rail that is upwardly inclined towards said upper exit aperture for guiding the upper toothed edge upwards towards said upper exit aperture, said upper exit aperture being configured to retain the upper toothed edge from being pulled out of said upper exit aperture as the upper toothed edge passes through said upper exit aperture; and a lower guide arrangement comprising a lower guide member engageable with said lower end cap that is configured to guide said lower toothed edge of said flexible screen into said lower elongate retaining channel of said lower guide track, said lower guide arrangement defining a lower guide passage having a base and a lower exit aperture through which the lower toothed edge passes during unrolling of the flexible screen and is configured to communicate with the lower elongate retaining channel, said lower exit aperture being configured to retain the lower toothed edge from being pulled out thereof as the lower toothed edge passes through said lower exit aperture, said lower guide member including an upwardly inclined guide ramp defining said base of said lower guide passage for guiding the lower toothed edge into said lower exit aperture.

9. The roller assembly of claim 8, wherein said lower guide arrangement includes a downwardly inclined guide rail positioned to one or both sides of said guide passage for guiding the lower toothed edge downwards towards said lower exit aperture.

10. The roller assembly of claim 8, further comprising said upper guide track, wherein said upper exit aperture has a profile that corresponds to a profile of said upper elongate retaining channel.

11. The roller assembly of claim 8, wherein said upper guide member is configured for press fit or frictional engagement within said upper end cap body.

12. The roller assembly of claim 8, wherein said upper guide member further comprises an upper ramp downwardly inclined towards said upper exit aperture.

13. The roller assembly of claim 12, wherein said first and second upper guide rails collectively define a lower base of said upper guide passage, and wherein said upper ramp defines an upper face of said upper guide passage.

14. The roller assembly of claim 8 further comprising said upper guide track and a spacer positionable between said upper guide arrangement and said upper guide track, wherein said spacer has a first side that is engageable with said upper guide track so as to resist lateral movement with respect to said upper guide track, a second side that is positionable adjacent said upper guide arrangement, and a through passage configured to pass the upper toothed edge from said upper exit aperture of said upper guide arrangement to said upper elongate retaining channel of said upper guide track, and wherein said through passage is tapered from said second side towards said first side.

15. The roller assembly of claim 14, wherein said upper guide track has at least one further channel in addition to said upper elongate retaining channel, and wherein said first side of said spacer has at least one projection that complements said at least one further channel in said upper guide track so that said spacer is slidably engagable with said upper guide track.

* * * * *